US005437539A

United States Patent [19]

Gysling et al.

[11] Patent Number: 5,437,539

[45] Date of Patent: Aug. 1, 1995

[54] APPARATUS FOR THE DYNAMIC CONTROL OF ROTATING STALL AND SURGE IN TURBO MACHINES AND THE LIKE

[75] Inventors: Daniel L. Gysling, Newton; Jonathan S. Simon, Somerville, both of Mass.

[73] Assignee: Massachusetts Institute of Technology, Cambridge, Mass.

[21] Appl. No.: 197,657

[22] Filed: Feb. 17, 1994

Related U.S. Application Data

[63] Continuation of Ser. No. 918,510, Jul. 22, 1992, abandoned.

[51] Int. Cl.[6] ..... F04D 19/02; F04D 27/02

[52] U.S. Cl. ..... 415/68; 415/69; 415/146; 415/147

[58] Field of Search ..... 415/1, 60, 62, 66, 68, 415/69, 146, 147

[56] References Cited

U.S. PATENT DOCUMENTS

| | | | |
|---|---|---|---|
| 1,822,778 | 9/1931 | Kaplan | 415/141 |
| 2,483,654 | 10/1949 | Magdeburger | 415/68 |
| 2,555,312 | 6/1951 | Bollay | 415/147 |
| 3,918,828 | 11/1975 | Kumm | 415/62 |
| 3,957,392 | 5/1976 | Blackburn | 415/146 |
| 4,657,480 | 4/1987 | Pfeil | 415/147 |

FOREIGN PATENT DOCUMENTS

| | | | |
|---|---|---|---|
| 1124752 | 10/1956 | France | 415/146 |
| 870617 | 3/1953 | Germany | 415/62 |
| 304638 | 1/1929 | United Kingdom | 415/146 |
| 583473 | 12/1946 | United Kingdom | 415/69 |
| 676769 | 8/1952 | United Kingdom | 415/147 |
| 696007 | 8/1953 | United Kingdom | 415/147 |
| 137013 | 2/1960 | U.S.S.R. | 415/147 |
| 1245760 | 7/1986 | U.S.S.R. | 415/146 |

OTHER PUBLICATIONS

Simon, J. S., and Valavani, L., in "A Lyapunov Based Nonlinear Control Scheme for Stabilizing a Basic Compression System Using a Close-coupled Control Valve," American Control Conference Proceedings, pp. 1-9 (1991).

Paduano, J., Epstein, A. H., Longley, J. P., Valavani, L., Greitzer, E. M., Guenette, G. R., "Active Control of Rotating Stall in a Low Speed Axial Compressor," ASME Paper 91-GT-88, pp. 1-10 (1991).

Epstein, A. H., Ffowcs Williams, J. E., and Greitzer, E. M., "Active Suppression of Compressor Instabilities," AIAA 10th Aeroacoustics Conference, pp. 1-12, 1986.

N. Venkatrayulu, D. Prithvi Raj and R. G. Narayanamurthi, "Influence of Freely Rotating Inlet Guide Vanes on the Return Flows and Stable Operating Range of an Axial Flow Fan," *Journal of Engineering for Power*, vol. 102, pp. 75-80, ASME (1980).

*Primary Examiner*—Edward K. Look
*Assistant Examiner*—James A. Larson
*Attorney, Agent, or Firm*—Steven J. Weissburg

[57] ABSTRACT

The invention is a turbo machine comprising a rotatably mounted blade row, such as a compressing or pumping rotor and apparatus for providing aerodynamic feedback to the blade row which feedback apparatus has substantially zero pressure difference across it. The feedback may be provided by various apparatus, including at least one free-rotor that is mounted in aerodynamic feedback with the blade row, for instance coaxially with respect to the axis of rotation of the blade row and freely rotatably with respect to the blade row. The free-rotor may also be located in ductwork in communication with the blade row. The feedback may also be provided by a blade row having a variable stagger angle and apparatus to adjust the stagger angle so that the mean pressure rise across the variable stagger angle blade row is zero. The invention also includes a method for controlling operating anomalies such as rotating stall and surge of a turbo machine such as a compressor using the above described apparatus.

20 Claims, 10 Drawing Sheets

APPARATUS FOR THE DYNAMIC CONTROL OF ROTATING STALL AND SURGE IN TURBO MACHINES AND THE LIKE

U.S. GOVERNMENT INTEREST

The U.S. Government has certain rights in this invention pursuant to Contract No. AFOSR-90-0059c, awarded by the Air Force Office Scientific Research.

This is a continuation of copending application Ser. No. 07/918,510 filed on Jul. 22, 1992, abandoned.

BACKGROUND OF THE INVENTION

This invention relates in general to turbo machines having a rotating stage, such as a compressor or pump and more particularly to turbo machines subject to operating anomalies known as "surge" and "rotating stall." Most particularly, this invention relates to a method of minimizing or eliminating the occurrence of such surge and stall anomalies, and an apparatus for the practice of such a method.

It is well known that the operating range of modern turbo systems is often limited by the onset of fluid dynamic instabilities. Many types of turbo machines suffer from such instabilities. For purposes of illustration, the example of a compressor is explored fully herein. However, the same principles apply to other turbo machines, such as fans and pumps. Further, the instabilities discussed arise in connection with axial and centrifugal (also known as radial) turbo machines. The invention can be applied to both axial and centrifugal turbo machines.

The instabilities in question are generally categorized as either "surge"or "rotating stall." These instabilities are shown schematically in FIGS. 1*a* and 1*b* respectively. Surge is an essentially one dimensional instability characterized by violent oscillations in mass flow through the compressor and pressure rise from the inlet of the compressor to the outlet of the compressor, averaged over an annulus of the compressor. Surge is shown schematically in FIG. 1*a*, which is a longitudinal cross-section of a compressor unit showing the full length of the compressor.

Rotating stall is shown schematically in FIG. 1*b*, showing a transverse cross section of a compressor at a point along the length of the compressor. Rotating stall is an essentially two or three dimensional instability in which regions of reduced or reversed mass flow rotate around the compressor annulus. Typically, the frequency of rotating stall is much higher than the frequency of surge.

Each type of instability degrades compressor performance and can lead to catastrophic structural failure of the compressor due to large unsteady aerodynamic loads and increased operating temperatures.

Compressors can be characterized by a non-dimensional performance map or curve showing the relation between the pressure rise coefficient across the length of the compressor and the flow coefficient through the compressor, at a constant rotational speed of the compressor. Such a curve, referred to as the "compressor characteristic," is shown schematically in FIG. 2, at 200. The onset of either rotating stall or surge generally occurs if the operating point is near the peak 202 of the compressor characteristic.

Typically, compressors are operated only in the region where the mass flow coefficient exceeds the mass flow coefficient at the peak 202 by some acceptable margin. This region is sometimes known as the "stable flow" region. The stable flow region is on the negatively sloped, right hand half of the map shown in FIG. 2. In the stable flow region, the compressor exhibits essentially steady, axially symmetric flow. A somewhat simplified explanation of why that region is stable is as follows. If the mass flow rate is reduced, due to some disturbance, from e.g. 0.5, this will cause the compressor to produce a slightly higher pressure rise, since, in this region, a mass flow decrease gives rise to a pressure increase. The increased pressure will tend to increase the mass flow through the compression system, and thus mass flow returns to its steady state value. Similarly, an increase in mass flow will cause a decrease in the pressure difference over the length of the compressor, which will result in less fluid being forced through, thus bringing the mass flow back down to the steady state amount.

Conversely, if the operating point were not in the stable region, for instance if the mass flow coefficient is less than what it would be at the peak 202, the steady, axially symmetric flow is not a stable operating condition. A decrease (or increase) in mass flow causes a decrease (or increase) in the pressure difference from inlet to outlet, which gives rise to a reduction (or increase) in mass flow, followed by another reduction (or increase) in pressure difference. Thus, the steady, axially symmetric flow is not stable, and the compression system settles into a limit cycle, generally in the form of rotating stall or surge. It should be noted that the dynamics of the system also come into play and must be considered to fully describe the phenomenon.

Although, surge and rotating stall generally have different time and length scales, both can be shown to result from the same basic physical mechanism. The mature form of the instability, either rotating stall or surge, has been correlated as a function of a compression system stability parameter (B). See generally, Greitzer, E. M., "The Stability of Pumping Systems—The 1980 Freeman Scholar Lecture," *Journal of Fluids Engineering*, Vol. 103, pp. 193–242 (1980), which is incorporated herein by reference. However, both forms of instability can occur simultaneously and interact non linearly as they develop.

In recent years, much effort has been directed toward suppressing these instabilities to increase the stable flow range of compression systems. Although fully developed rotating stall and surge are generally large amplitude, highly nonlinear oscillations, each can be viewed as limit cycle oscillation which begins as a small amplitude, essentially linear instability. Thus, rotating stall and surge can be suppressed by modifying the unsteady dynamics of the compression system. Stabilization is achieved by sensing small unsteady flow perturbations and, through a feedback mechanism, generating control actions that damp out the disturbance. Since the disturbances are stabilized at small amplitude, the required control power can be significantly less than the steady state power of the compression system.

Unsteady Energy Production

For dynamic systems to exhibit self excited oscillations (such as surge and rotating stall), an element in the system must be capable of generating unsteady energy. Unsteady energy is defined here as the product of variations in pressure difference across the compressor (as compared to a substantially time invariant pressure difference) and variations in flow through the compressor (as compared to a substantially time invariant flow). The units of "unsteady energy production" are the units of power and it represents the power fed into small oscillatory disturbances integrated over the annulus of the compressor.

"Unsteady energy" should not be confused with energy related to transients involved in changing steady state operating points. The unsteady energy as defined in this context is typically produced at an operating point that is nominally "steady state," however, small variations in the flow rate and pressure rise occur due to flow disturbances, or noise, that are always present in actual turbo machines.

Generally, in compression systems, the compressor is the only element capable of acting as an unsteady energy producing, negative damper. This concept is developed more rigorously for one dimensional mass flow oscillations in compression systems by Simon, J. S., and Valavani, L., in "A Lyapunov Based Nonlinear Control Scheme for Stabilizing a Basic Compression System Using a Close-coupled Control Valve," 1991 American Control Conference Proceedings.

Therefore, the response of a compressor to a perturbation in mass flow gives an indication of that compressor's stability with respect to self exalted oscillations such as surge and rotating stall. For harmonic oscillations in mass flow, one relevant form of unsteady energy produced over one cycle (of the self excited oscillation) by a generic flow element can be defined as the integral over one period of: the product of 1) the perturbation in the pressure rise through the compressor, measuring static pressure at the outlet and total pressure at the inlet; and 2) the perturbation in mass flow through the compressor. The pressure rise so defined is sometimes referred to as the "total to static pressure rise" or simply "pressure rise" in the art. It should be noted that this pressure rise is measured at two different points in space, not time. According to this definition there is a net amount of unsteady energy produced, or dissipated by an element over a cycle, only when the pressure rise and mass flow oscillation have some component in phase. Otherwise, the integral would be zero.

Because the instabilities arise from initially small perturbations, it is appropriate to use a linearized model of a compression system to perform a stability analysis. In a linearized model, the compressor transfer function determines the relationship between pressure rise and mass flow oscillations.

In general, the compressor transfer function is a frequency dependent, complex quantity determining both the magnitude and phase of the perturbations in pressure rise with respect to mass flow perturbations. The real part of the transfer function determines the component of pressure rise in phase with the mass flow, and thus, determines the unsteady energy produced over a cycle by the compressor. The imaginary part of the transfer function, determines the component of pressure rise out of phase with the mass flow oscillations, and represents a lag in the compressor performance and has no direct effect on the stability of the compression system.

To describe the system, it is useful to characterize the compressor transfer function as purely real and independent of frequency. Then, for small disturbances, the compressor follows its steady state characteristic. This situation, referred to as "the quasi steady assumption," is idealized, however it is generally adequate to describe the operation of typical compression systems for the time scales of the flow disturbances. If the compressor is operating quasi-steadily, the compressor transfer function is given directly by the linearized slope of the steady state, axially symmetric compressor characteristic, such as is shown at 200 in FIG. 2.

Therefore, for axially symmetric flow oscillations (surge), the unsteady energy production of the compressor over one period of duration T of unsteady oscillation is given by:

$$\delta E = \frac{\partial \Psi}{\partial \phi} \int_0^T [\delta\phi(t)]^2 dt \tag{1}$$

where $$\frac{\partial \Psi}{\partial \phi}$$

is the slope of the axially symmetric compressor characteristic, shown in FIG. 2, and $\delta\phi$ is the perturbation in mass flow, which is a function of time. As shown in FIG. 2, $$\frac{\partial \Psi}{\partial \phi}$$

is positive at point 204, as indicated by the tangent line at that point, and is negative at point 206, as indicated by the tangent line at that point.

For axially asymmetric oscillations (i.e., rotating stall), where mass flow $\phi$ is a function of both time T and angular position, $\Theta$, this unsteady energy can be integrated around an annulus yielding:

$$\delta E = \frac{\partial \Psi}{\partial \phi} \int_0^{2\pi} \int_0^T [\delta\phi(\theta,t)]^2 dt d\theta. \tag{2}$$

Because $[\delta\phi]^2$ is always positive, the sign of $$\frac{\partial \Psi}{\partial \phi},$$

the linearized slope of the quasi-steady, axially symmetric compressor characteristic shown in FIG. 2, is the criterion determining whether the compressor will add energy to small disturbances, thus destabilizing the system, or dissipate energy from the disturbances, thus stabilizing the system. Thus, in compression systems operating quasi-steadily, the linearized slope of the compressor characteristic being positive represents a necessary, but not sufficient, requirement for instability.

Close-Coupled Flow Devices

Many researchers have used steady state flow devices, such as throttles, gauzes or additional stable compressor stages, closely coupled to the main compressor stages, to extend the stable operating range of compression systems. See generally, Greitzer, E. M., "Coupled Compressor-Diffuser Flow Instability," *Journal of Aircraft*, Vol. 14, pp. 233–238 (1977). The combination of the original compressor and the closely coupled flow device appear to the balance of the compression system as a modified compressor. In these devices, the compressor and the closely coupled device generally operate quasi-steadily. Therefore, instability occurs at the peak of the combined steady state characteristic. The effect of close coupled flow devices is shown schematically in FIG. 2.

The isolated compressor characteristic is shown by curve 200. The characteristic of the flow resistance is shown at 208. As mass flow increases, the pressure rise (which is negative for a resistance) across the element decreases. The resultant characteristic for the closely coupled combined elements is shown at curve 210. As can be seen, the peak 212 of the resultant characteristic curve 210 is at a mass flow coefficient that is lower than the mass flow coefficient corresponding to peak 202 of the isolated compressor characteristic 200. Thus, the safe operating range for the compressor and the closely coupled flow resistance is larger, extending to a lower mass flow, than for the safe operating range of the isolated compressor. Although these devices enhance system stability, the efficiency and pressure rise of the compression system is decreased.

Unsteady Compressor Performance

There is, however, no physical reason why the stability of compression systems for the time scales and length scales associated with instabilities (which are generally relatively short) needs to be determined by the slope of the quasi-steady axially symmetric compressor characteristic. Recently, active control techniques have been used to stabilize a system against both rotating stall and surge by instability. See generally, Paduano, J., Epstein, A. H., Longley, J. P., Valavani, L., Greitzer, E. M., Guenette, G. R., 1991, "Active Control Of Rotating Stall in a Low Speed Axial Compressor," ASME Paper 91-GT-88; Epstein, A. H., Ffowcs Williams, J. E., and Greitzer, E. M., 1989, "Active Suppression of Compressor Instabilities", *Journal for Propulsion and Power,* Vol. 5, pp. 204–211; and Pinsely, J. E., Guenette, G. R., Epstein, A. H., Greitzer, E. M., 1991, "Active Suppression of Centrifugal Compressor Surge," *Journal of Turbomachinery,* Vol. 113, pp. 723–732. The actively stabilized compression systems exhibited stable operation on portions of the compressor map where $$\frac{\partial \Psi}{\partial \phi},$$

the slope of the steady state characteristic was positive, i.e. at a point like point 204 in FIG. 2, where absent the control, the compressor would add unsteady energy to the system and the system would be unstable. Thus the slope of the steady state, axially symmetric compressor characteristic for a compression system does not solely govern the stability of the system.

To stabilize the system for rotating stall, prior art active control techniques have required arrays of spatially distributed, high bandwidth sensors and actuators. (For surge, only a single sensor and actuator have been used.) The bandwidth and spatial resolution required by the active control strategies are determined by the time scales and length scales of the disturbances to be stabilized.

For instance, some researchers have proposed placing high speed actuators in a compression system, to vary operating parameters in response to a measured operating process variable. Parameters that can be varied include the angle of the rotor and stator blades, bleed off valves, throttle area, mass injection, fuel control, etc. A principal drawback of these approaches is that they are computationally intensive, and also typically require very small, costly, fragile actuators which all must be controlled and coordinated in the harsh environment in which compressors often operate. The sensors and the actuators must operate over a wide bandwidth and at a high spatial resolution. Further, some address the surge problem and others the rotating stall, but to date, none have addressed both with a unified approach.

Several researchers have successfully stabilized rotating stall or surge using various feedback mechanisms to modify the unsteady system dynamics. From an energy viewpoint each successful control strategy achieved stabilization by one of two methods: either by increasing the overall compression system's ability to dissipate unsteady energy produced by the compressor (surge only), or by forming an equivalent compressor that is unable to feed perturbation energy into the compression system using a flow device close coupled to the compressor (surge or rotating stall).

Objects of the Invention

Thus, the objects of the invention include, to provide a method and an apparatus for preventing compressor surge and rotating stall: that addresses both problems in a unified manner; that does not require a multitude of sensors and actuators; that does not require high bandwidth or high spatial resolution sensors and actuators; that is straightforward and inexpensive to manufacture and maintain; that is robust with respect to the environments in which compressors are commonly used and variations of system parameters that might be encountered; that counters surge and stall using only a relatively small amount of power, compared to the compressor output; that permits extension of the normal operating range of a compressor; that does not significantly reduce the pressure rise through the compressor or its efficiency; and that can be used in a wide variety of compressors.

BRIEF DESCRIPTION OF THE INVENTION

A first preferred embodiment of the invention is a turbo machine comprising: a rotatably mounted blade row rotor; at least one free-rotor, the at least one free-rotor: spaced from the blade row so as to provide aerodynamic feedback to the blade row; and mounted freely rotatably with respect to the blade row.

In a second preferred embodiment, the invention is a turbo machine comprising: a rotatably mounted blade row; and means for providing an aerodynamic feedback signal to the blade row which maintains the mean pressure difference across the feedback means at substantially zero.

In a third preferred embodiment, the invention is a turbo machine comprising a unitary means for: sensing small perturbations in unsteady energy produced by the turbo machine at the onset of operating anomalies; generating an aerodynamic feedback signal in response to the perturbations; and substantially maintaining the steady state operating conditions of the turbo machine.

In a fourth preferred embodiment, the invention is a turbo machine comprising: a rotatably mounted blade row having a variable stagger angle; and means to adjust the stagger angle of the blade row so that the mean pressure rise across the blade row is substantially zero.

In a fifth preferred embodiment, the invention is a method for controlling operating anomalies of a turbo machine having a rotatable blade row, comprising the steps of: providing a unitary means for sensing small perturbations in unsteady energy produced by the blade row at the onset of the anomalies and for generating an aerodynamic feedback signal in response to the perturbations; placing the unitary sensing and feedback means in aerodynamic communication with the blade row; and operating the blade row and the unitary sensing and feedback means such that the feedback means operates with substantially zero pressure difference across it and generates an aerodynamic feedback signal in response to the perturbations so as to stabilize the blade row.

DETAILED DESCRIPTION OF PREFERRED EMBODIMENTS OF THE INVENTION

The present invention presents a new approach to stabilizing compression systems by decoupling the steady performance of the turbo machine system from the unsteady performance without requiring additional high bandwidth and spatial resolution sensors or actuators. As has been mentioned, the invention is applicable to a wide variety of turbo machines, including but not limited to compressors, pumps and fans of either the axial or centrifugal type. The following discussion uses as an example an axial compressor system. However, the principals apply analogously to the other types of turbo machines, and no loss of generality is intended.

The invention incorporates a close-coupled stabilizing element with steady state performance that varies on time scales that are slow with respect to the time scales associated with instabilities. The time scale associated with the type of instabilities under examination is on the order of one rotor revolution for the rotating stall and one Helmholtz period for surge. These additional dynamics enable the close-coupled device to have a significant effect on the stability of the compression system, without degrading the steady state, axially symmetric performance of the compression system.

Figure 3:
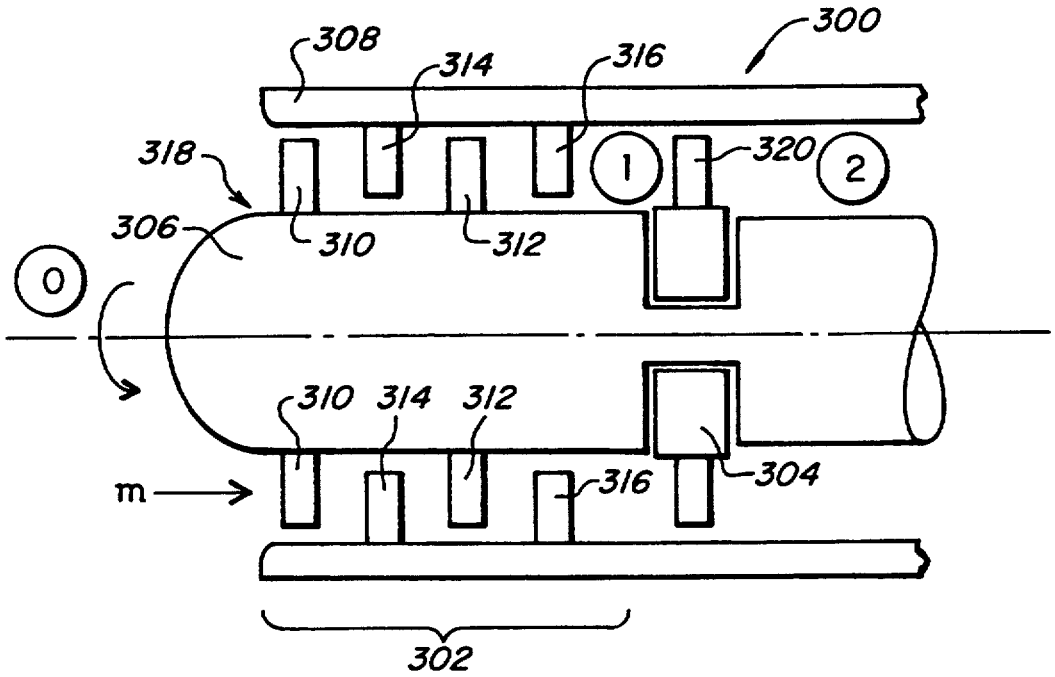
FIG. 3 shows schematically a preferred embodiment of the claimed apparatus of the invention in a longitudinal cross-section.

A first preferred embodiment of the invention to increase the stable flow range of compression systems that exploits the concepts of using a closely coupled stabilizing element with steady state performance that varies on time scales that are slow with respect to the time scales associated with the instabilities is to close-couple a rotor that is free to windmill in the flow. The rotor must be arranged so as to provide aerodynamic feedback to the compressor. The most basic configuration is to place the free-rotor concentric with a stage of a compressor. A schematic of this system is shown in FIG. 3. It is also possible to mount the rotor in ductwork in aerodynamic communication with the compressor. Other schemes are also possible and are discussed after the basic embodiment is explained.

A compressor system 300 (FIG. 3) includes a conventional compressor 302 and a free-rotor 304. The compressor 302 includes an axially symmetric rotor body 306 (or spool), free to rotate with respect to compressor body 308. Rotor 306 carries several rows of rotor blades 310, 312. Typically, from one to over ten rows of rotor blades are carried by such a spool. Each row has many individual blades around the circumference, with typical rows including from 10 to 60 blades. It is also common for there to be one, two or three spools in series, i.e. dmill in the flow. The rotor must be arranged so as to provide aerodynamic feedback to the compressor. The most basic configuration is to place the free-rotor concentric with a stage of a compressor. A schematic of this system is shown in FIG. 3. It is also possible to mount the rotor The fluid is turned in the direction the rotor is rotating. As the fluid leaves the locality of a rotor blade of one stage, e.g. 310, it comes into contact with a stator blade of row 314, which removes the swirl imparted by the rotor and increases the pressure. After leaving the locality of the stator blade of rank 314, the fluid encounters rotating rotor blade of row 312, which turns the fluid again in the direction of rotor motion. This continues along the length of the compressor 302.

A principal aspect of the invention is a free-rotor 304, having a row of rotor blades 320, shown following the compressor in the embodiment shown in FIG. 3. Although the following analysis focuses on a rotor rotating in the direction the compressor is rotating, the free-rotor is also effective if counter rotating. Also, additional free-rotors are more effective than one free-rotor, provided that they are separated from each other by a stationary blade row. Also, the effect of the free-rotor can be increased by putting counter rotating free-rotors in series. If each free-rotor rotates counter to free-rotors adjacent it, it is not necessary to have stationary blade rows between the free-rotors. Although the analysis which follows models a free-rotor placed downstream of the compressor, the overall qualitative effects of the free-rotor are independent of whether the free-rotor is placed upstream or downstream of the compressor, or even in between separate compressor stages. The rotor 304 is free to rotate with respect to both the rotor 306 and the compressor body 308. It is not typically mechanically driven. It is beneficial for the free-rotor to be placed in the immediate axial vicinity of the compressing rotor, significantly less than one rotor radius away.

The free-rotor 304 controls the system as follows. As the steady state operating conditions of the compression system are slowly varied, the rotational speed of the free-rotor 304 adjusts to produce a steady state pressure difference across it of zero. Since the free-rotor 304 is unloaded during normal operating conditions, the steady state, axially symmetric performance of the compression system is essentially identical to a compressor without the free-rotor.

However, for small axially symmetric (surge) and axially asymmetric (rotating stall) mass flow perturbations with time scales such that the rotary inertia maintains the rotational speed of the free-rotor 304 essentially constant, the free-rotor will follow its own constant speed pressure rise versus mass flow characteristic. Since the flee-rotor is operating on a portion of its characteristic where flow perturbations are highly damped, i.e. lade of row 314, which removes the swirl imparted by the rotor and increases the pressure. After leaving the locality of the stator blade of rank 314, the fluid encounters rotating rotor blade of row 312, which turns the fluid again in the direction of rotor motion. This continueg to claim 1, said feeding unit comprising a nail for engaging an edge of each of said printed wiring boards when each of said printed wiring boards is fed to said predetermined position and wherein said sensor is attached to said nail. of the characteristic of the free-rotor alone, each operating in its quasi steady region. A quick perturbation increasing the mass flow causes the free-rotor 304 to experience a decrease in pressure rise across it, which tends to impede additional increases in mass flow. Similarly, a decrease in mass flow causes the free-rotor 304 to experience an increase in the pressure rise across which forces additional mass to flow through it, thereby negating the effect of the negative perturbation in mass flow.

Figure 1A:
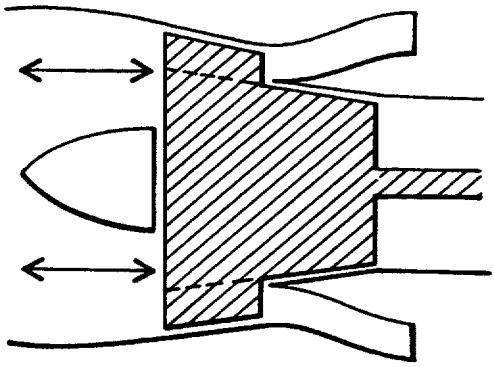
FIG. 1*a* is a schematic view illustrating the surge phenomena, showing a compressor in longitudinal cross-section.
Figure 1B:
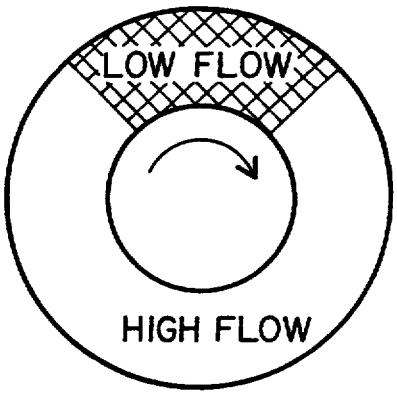
FIG. 1*b* is a schematic view illustrating the rotating stall phenomena, showing a compressor in radial cross-section.
Figure 2:
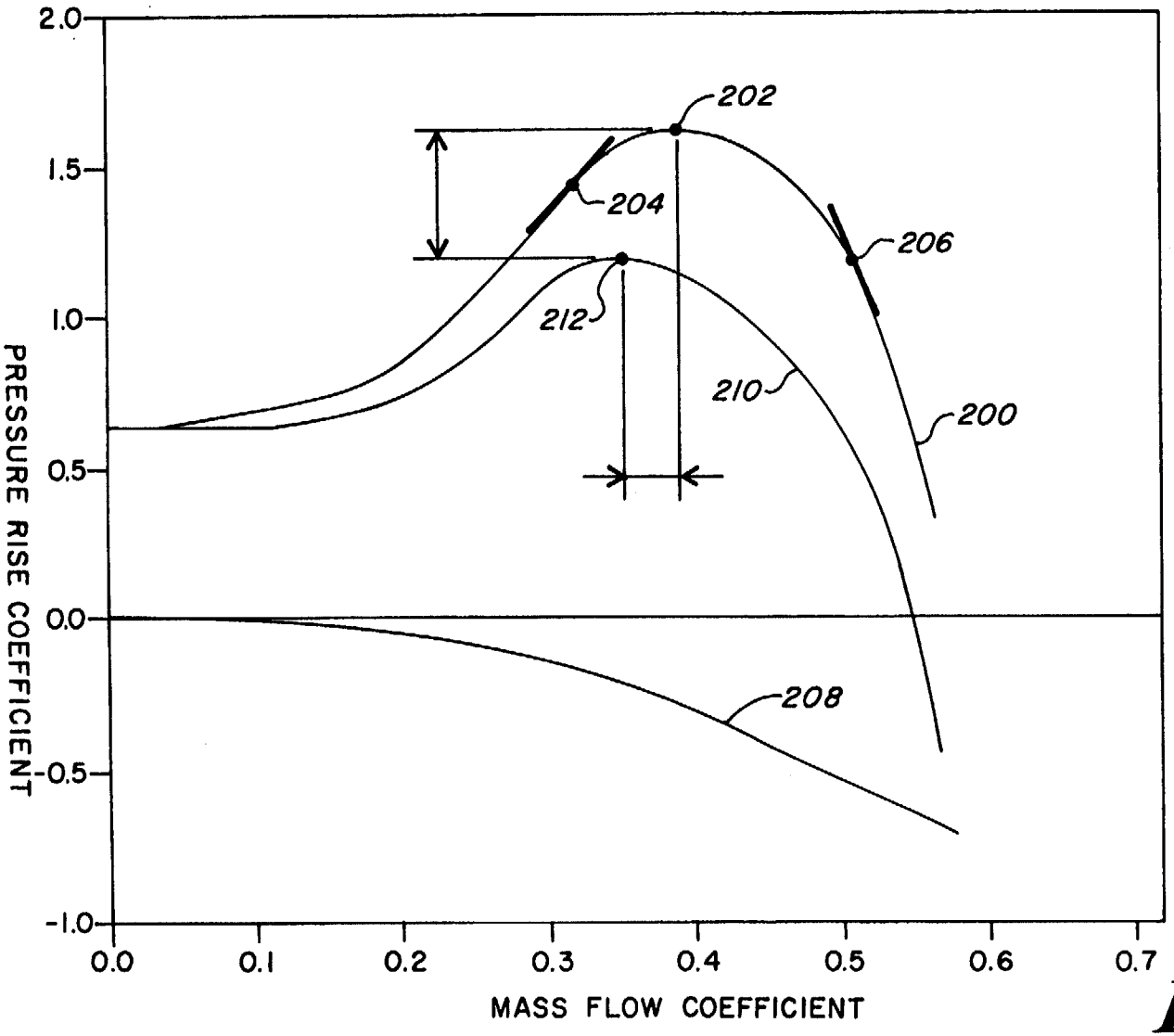
FIG. 2 shows schematically a compressor characteristic curve, showing constant speed curves relating the mass flow coefficient to the pressure rise coefficient for a compressor, a flow resistance, and a compressor close coupled with a flow resistance.

The effect the flee-rotor has on the compressor differs from the effect of a passive steady state control device, such as the flow device described with respect to FIG. 2. With a passive steady state flow device, the unstable region extends over less of the mass flow domain than the unstable region that would exist without the flow device. However, operation in the smaller unstable region to the left of the peak of the combined steady state characteristic, still results in instability. Further, the stable region includes a smaller pressure rise than the stable region without the control device.

With the apparatus of the invention installed, the compressor can be run at pressure rise and mass flow combinations that would otherwise have been unstable. There is little loss in efficiency and pressure rise. With the free-rotor installed, stable operation exists to the left of the peak of the compressor characteristic of the combined apparatus. The increase in stable flow range achievable with a free-rotor does not scale with the amount of pressure rise lost (and efficiency lost) as it does with passive devices. In fact, the free-rotor extends the flow range independently of the steady state losses by modifying only the unsteady behavior of the compressor system.

From a feedback view point, the free-rotor 304 extends the stable flow range through aerodynamic feedback. The free-rotor effectively senses mass flow oscillations and produces pressure perturbations to stabilize the system. The flee-rotor performs the function of both an array of sensors and an array of actuators. This satisfies the demanding bandwidth and spatial resolution requirements for stabilization of instabilities in turbomachinery. The free-rotor also automatically adjusts for slow variations without the need for additional sensors and actuators.

It should be noted that, unlike known devices that provide some sort of aerodynamic feedback, the apparatus of the invention requires no external power source, such as a motor, to generate its feedback signal. The signal is essentially due to the inertia of the free rotor, which, causes the free rotor to maintain its speed,which creates a pressure signal that is communicated back to the compressor.

Although the free-rotor itself tends to change its speed with a characteristic time constant that is long as compared to the characteristic time constants of the system perturbations sought to be controlled, the feedback signal is generated with a characteristic time constant that is of the same order of magnitude as that of the perturbations. The feedback signal is the rise (or decrease) in pressure between the compressor and the free-rotor, which occurs quickly.

In a preferred embodiment, the apparatus of the invention is a unitary element that acts as both the sensor of the perturbation and the actuator, or means to generate an aerodynamic feedback signal. The free rotor constitutes such a unitary element. It senses the perturbation, by experiencing the effects of any increase (or decrease) in pressure upstream of it. It generates a signal in response to this sensed perturbation, by substantially maintaining its speed, thereby generating an increased pressure signal that is felt back upstream by the compressor. Thus, there is no need for a sensor to sense the perturbation, and a separate signal generator to cause an actuator to make a physical change that will counter the effects of the perturbation to suppress the instability. This is what is meant by unitary. Of course, the free rotor could be made from several different parts, e.g., the body, the blades, etc. However, the element that performs both the sensing and the signal generating function works as a unified whole.

Figure 5:
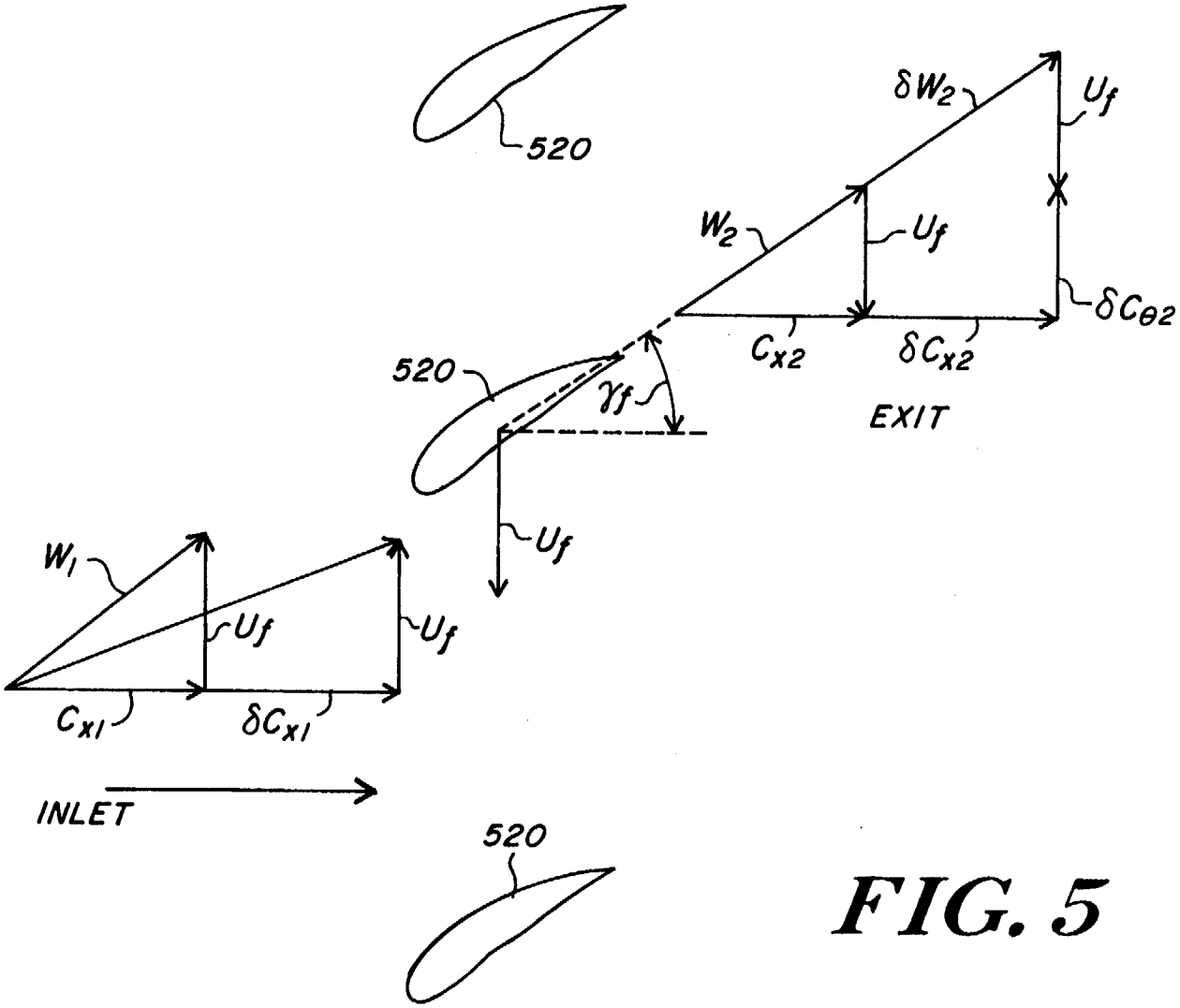
FIG. 5 shows schematically the flow through the free-rotor of a preferred embodiment of the invention.

The quantitative effect of the free-rotor on the stability of the compression system is illustrated with respect to a compression system with the compressor close-coupled to an ideal (lossless) free-rotor as shown in FIG. 3. The free-rotor has uncambered blades at a fixed stagger angle as shown in FIG. 5. This embodiment is shown for simplification of analysis only. It is also possible but not preferred, to use cambered blades, or blades that are not at a fixed angle.

At the equilibrium point, there can be no net torque acting on the free-rotor (neglecting bearing drag). Thus the rotor does no net turning of the flow. Assuming that the flow exiting the conventional compressor remains purely axial (flow angle fixed by the last stator row), this condition sets the equilibrium free-rotor speed $U_f$.

$$U_f = C_x \tan\gamma_f \quad (3)$$

where $C_x$ is inlet flow velocity in the axial direction and $\gamma_f$ is the angle at which the flee-rotor blades are set with respect to the axis about which the free-rotor rotates.

(To facilitate consideration of the equations herein, the nomenclature, symbols, subscripts and superscripts used are summarized in Table I, which precedes the claims appended hereto.) The total to static pressure rise of the modified compressor is given by:

$$P_{S2}-P_{T0}=P_{S2}-P_{S1}+P_{S1}-P_{T0}, \tag{4}$$

where $P_{S2}$ and $P_{S1}$ are the static pressures downstream and upstream of the free-rotor respectively and $P_{T0}$ is the total pressure at the inlet to the compressor. The stations "0", "1" and "2" are indicated on FIG. 3. If the exit flow angle relative to the free-rotor is fixed by the free-rotor, the static-to-static pressure rise across the free-rotor is given by:

$$P_{S2}-P_{S1}=\tfrac{1}{2}\rho(U_f^2-C_x^2\tan^2\gamma_f). \tag{5}$$

Nondimensionalizing by the tip speed of the conventional compressor yields the total to static pressure rise across the modified compressor:

$$\Psi(\phi,\tilde{U}_f)=\Psi_{55}(\phi)+\tilde{U}_f^2-\phi^2\tan^2\gamma_f, \tag{6}$$

where $\Psi_{55}(\phi)$ is the steady state characteristic. For steady state operation, the characteristic of the combination reduces to the characteristic of the conventional compressor, since $\tilde{U}_f=\phi\tan\gamma_f$ at equilibrium. However, for unsteady perturbations in which the free-rotor speed is essentially constant, the real part ($M_c$) of the modified compressor transfer function is given by:

$$M_c=\frac{\partial\Psi}{\partial\phi}-2\phi\tan^2\gamma. \tag{7}$$

When the real part of the compressor transfer function is zero there is no net unsteady energy production by the modified compressor and thus, a simplified stability criterion for both rotating stall and surge is given by:

$$\frac{\partial\Psi}{\partial\phi}<2\phi\tan^2\gamma. \tag{8}$$

Thus, the compression system is predicted to be stable for all slopes of steady state characteristics less than $2\phi\tan^2\gamma$.

Figure 4:
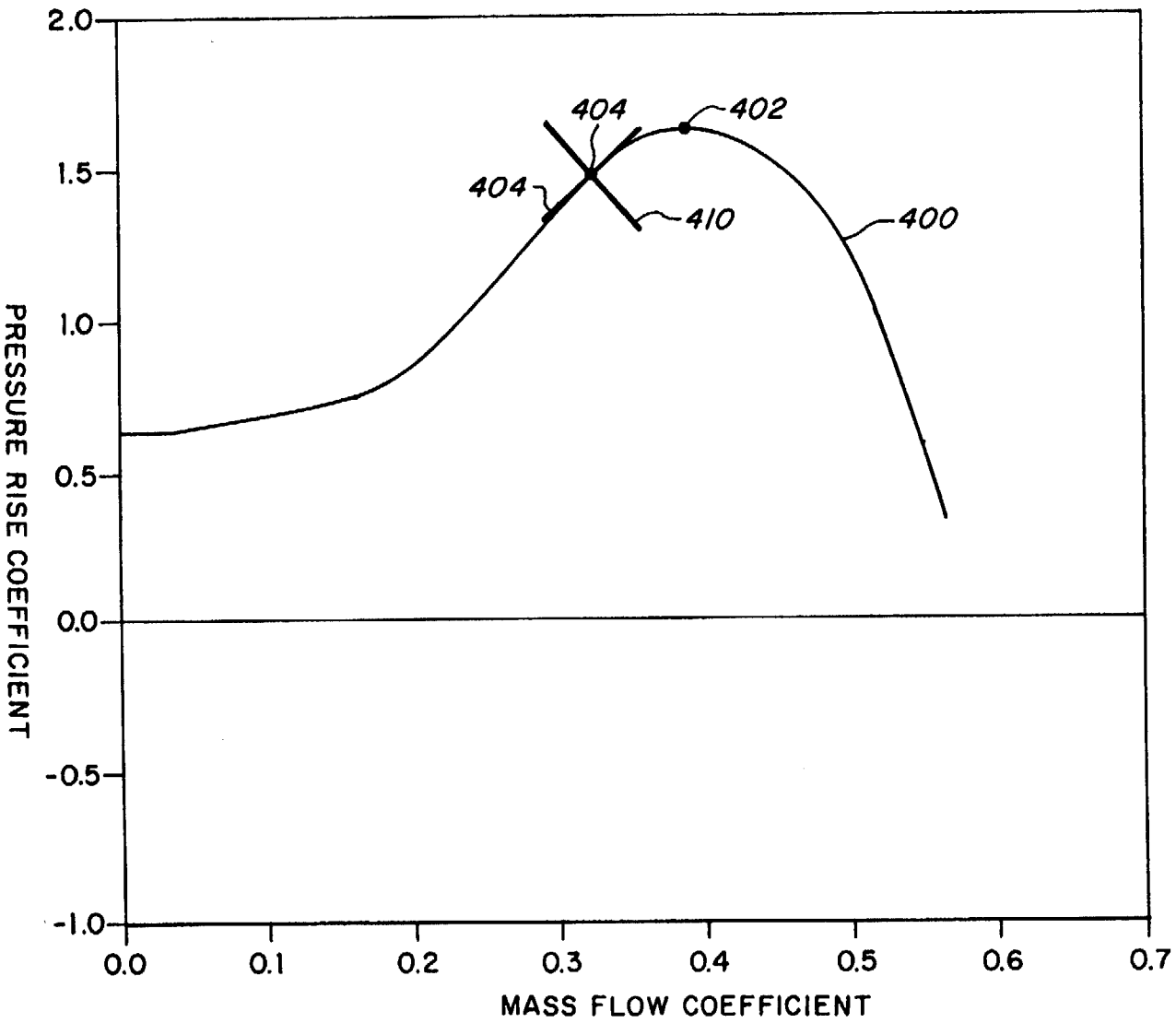
FIG. 4 shows schematically a Compressor characteristic curve indicating the effect on the compressor of a close coupled controller of the apparatus of the invention.

As shown in FIG. 4, the modified compression system exhibits stable operation in regions of the compressor map where the slope of the steady state characteristic is positive, i.e. regions which are unstable for an unmodified compressor, such as at point 404. This is because for a short scale disturbance (i.e. that associated with rotating stall and surge), the free-rotor operates along the negatively sloped line (410). Thus, for short duration disturbances, the net combined slope of the compressor and free-rotor is effectively negative and the system is therefore stable. The foregoing simplified stability analysis, captures the dominant physical mechanism behind compression system stabilization; preventing the compressor from adding energy to flow disturbances. The following more detailed state of the art stability analysis includes the effects of the free-rotor dynamics, defines relevant time scales, and assesses the effects of various system parameters.

Surge Analysis

Figure 6:
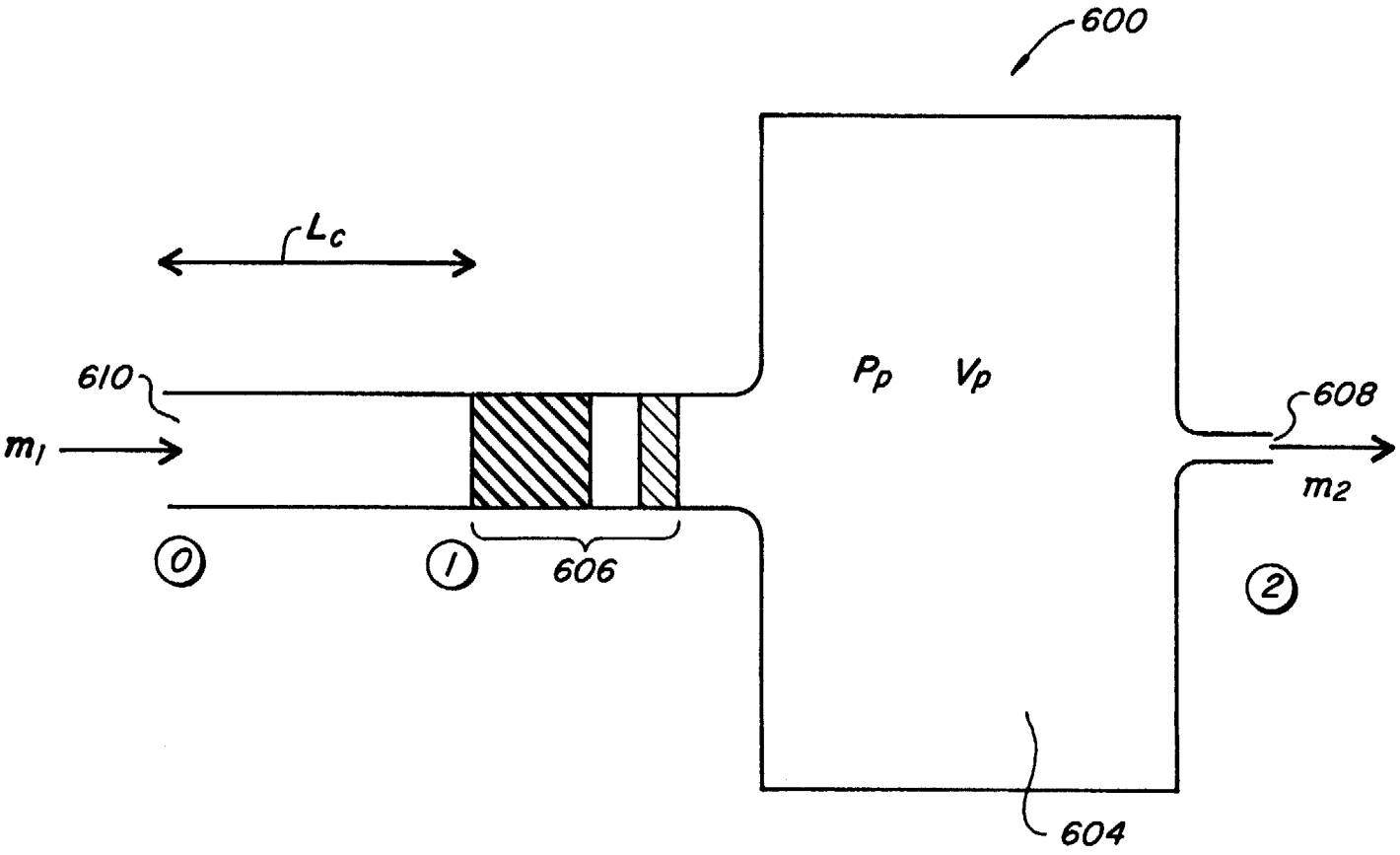
FIG. 6 shows schematically a compression system incorporating the free-rotor of the invention, the system being modeled as a Helmholtz resonator.

The stability of the compression system with respect to surge is demonstrated using a lumped parameter model. A schematic of the lumped parameter model of the compression system is shown in FIG. 6. The model of the basic compression system has been used by several other authors and has been shown to adequately describe the stability of most modern compression systems. See generally, Greitzer, E. M., "The Stability of Pumping Systems—The 1980 Freeman Scholar Lecture", Journal of Fluids Engineering, Vol. 103, pp. 193–242 (1981); Emmons, H. W., Pearson, C. E., and Grant, H. P., "Compressor Surge and Stall Propagation", ASME Transactions, Vol. 77, pp. 455–469 (1955); and Gysling, D. L., Dugundji, J., Greitzer, E. M., Epstein, A. H., "Dynamic Control of Centrifugal Compressor Surge Using Tailored Structures," *Journal of Turbomachinery*, Vol. 113, No. 4, pp. 710–722 (1991).

In this model, the compression system is modeled as a Helmholtz resonator 600 where the fluid in the inlet ducting 610 models the system inertia. The compressibility of the fluid in the plenum 604 models the system compliance, and the flow through the compressor and free-rotor 606 and throttle 608 models the system damping. Fluctuations in annulus averaged mass flow produce fluctuating torque on the free-rotor. Thus, the rotational dynamics of the free-rotor are included in the compression system stability calculation. The equations of motion are developed below. Analysis of momentum in the inlet duct provides:

$$\frac{d\dot{m}_1}{dt}=\frac{A_{in}}{L_c}(P_1-P_0), \tag{9}$$

where $\dot{m}$ is the mass flow rate, $A_{in}$ is the cross-sectional area of the inlet 610, $L_c$ is the length of the inlet, and P is the pressure, with subscripts relating to the corresponding locations on FIG. 6, "0" being the inlet 610, "1" being the inlet to the compressor 606 and "2" being the throttle 608.

Analysis of mass conservation in the plenum yields:

$$\frac{d(\rho_p V_p)}{dt}=\dot{m}_1-\dot{m}_2, \tag{10}$$

where $\rho$ is the density, V is the volume, and the subscript p refers to the plenum 604.

Analysis of the free-rotor dynamics yields:

$$\frac{dU_f}{dt}=\frac{R}{J}\tau, \tag{11}$$

where R is the radius of the flee-rotor, J is the rotational inertia of the free-rotor and $\tau$ is the torque acting upon the free-rotor.

The pressure rise through the compressor 606 and free-rotor and pressure drop through the throttle 608 are given respectively by:

$$P_1+\Delta P_c(\dot{m}_1,U_f)=P_p; \tag{12}$$

$$P_p-\Delta P_{throttle}(\dot{m}_2)=P_0, \tag{13}$$

where $\Delta$ indicates the change in pressure across the indicated device. The torque applied to the free-rotor is given by the change in angular momentum of the fluid across the free-rotor:

$$\tau=-\dot{m}_1R(U_f-C_x\tan\gamma_f). \tag{14}$$

The perturbation in total to static pressure rise across the compressor, $\Psi$, is related to the perturbations in mass flow, $\phi$, and the perturbations in free-rotor wheel speed, $\tilde{U}_f$. This relation is expressed in nondimensional form as follows:

$$\delta\Psi=\delta\Psi_c(\phi)+2\tilde{U}_f\delta\tilde{U}_f=2\phi\tan^2\gamma_f\delta\phi. \quad (15)$$

$\Psi$ and $\phi$ are the nondimensional total to static pressure rise and mass flow, respectively:

$$\Psi=\frac{\Delta P_{T-S}}{\frac{1}{2}\rho_0 U_T^2} \quad (16)$$

and $$\phi=\frac{\dot{m}}{\rho_0 A_{in} U_T}. \quad (17)$$

Linearizing and non-dimensionalizing the equations of motion, assuming isentropic compression in the plenum, and assuming solutions of the form $e^{st}$, yields the following eigenvalue problem:

$$\begin{bmatrix} B\left(\frac{\partial\Psi}{\partial\phi}-2\phi\tan^2\gamma_f\right)-s & -BM_t & 2B\phi\tan\gamma_f \\ \frac{1}{BM_t} & -\frac{1}{BM_t}-s & 0 \\ \frac{B}{\tilde{J}}\phi\tan\gamma_f & 0 & -\frac{B}{\tilde{J}}\phi-s \end{bmatrix}\begin{Bmatrix}\delta\phi_1\\ \delta\phi_2\\ \delta U\end{Bmatrix}=0. \quad (18)$$

B is the compression system stability parameter, defined as:

$$B=\frac{U_T}{2\omega_h L_h}, \quad (19)$$

where $\omega_h$ is the natural frequency of the system, referred to as the "Helmholtz frequency".

$M_t$ is the slope of throttle characteristic, and $\tilde{J}$ is the nondimensional rotational inertia of the free-rotor and is defined as:

$$\tilde{J}=\frac{J}{2\rho_0 R^2 L_c A_{in}}. \quad (20)$$

Non-dimensional time is given by: $\tilde{t}\equiv\omega_h t$.

This eigenvalue problem can be solved for the values of s which govern the linear stability of the compression system by setting the determinant of the system equal to zero. This leads to a third order characteristic equation of the form:

$$S^3+A_2S^2+A_1S+A_0=0. \quad (21)$$

The Routh Criteria for third order systems guarantees stability if the following conditions on the coefficients in the characteristic equation are met:

$$A_2, A_1, A_0>0 \quad (22)$$

and $$A_2\times A_1>A_0. \quad (23)$$

These conditions are always satisfied when the real part of the constant free-rotor speed compressor transfer function is negative, i.e. if $$\frac{\partial\Psi}{\partial\phi}\leqq 2\phi\tan^2\gamma_f,$$

providing that the following constraints on system parameters are met: 1) the slope of the compressor quasi-steady characteristic is less than the slope of the throttle characteristic, i.e.

$$\left(\frac{\partial\Psi}{\partial\phi}\leqq M_t\right); \text{ and} \quad (23a)$$

2) the free-rotor inertia is larger than a critical value. This critical value for free-rotor inertia is given in terms of system parameters by:

$$\tilde{J}\geqq\tilde{J}_{crit}=\phi B^2 M_1. \quad (24)$$

This stability criteria is independent of the B parameter for compression systems with free-rotors that have sufficient rotary inertia. For typical compression systems, the critical value for the rotary inertia can be obtained using conventional materials and construction.

The unsteady performance of the modified compressor is quantified with reference to the compressor transfer function, which is derived from the linearized model of the compression system. Using the transfer function relating fluctuations in free-rotor-speed to the compressor mass flow oscillations, the complex compressor transfer function for the modified compressor is given as a function of frequency in terms of system parameters. The real part of the compressor transfer function is given by:

$$M_c(\tilde{\omega})=\frac{\partial\Psi}{\partial\phi}-2\phi\tan^2\gamma_f\left(1-\frac{1}{1+\left(\frac{\tilde{J}\tilde{\omega}}{B\phi}\right)^2}\right). \quad (25)$$

where $\tilde{w}$ is the frequency of oscillation nondimensionalized by the Helmholtz frequency. In the limit of steady state operation, the real part of the compressor transfer function $M_c$ reduces to the slope of the steady state characteristic $$\frac{\partial\Psi}{\partial\phi}.$$

In the limit of high frequency, the real part of the compressor transfer function (equation no. 25) reduces to that of the modified compressor with constant free-rotor speed (equation no. 7).

Thus, for some intermediate range of frequency disturbances, a modified compressor operating with a steady state slope of $$\frac{\partial\Psi}{\partial\phi} = 2\phi\tan^2\gamma_f;$$

the compressor is capable of producing unsteady energy. However, if the system parameters meet the conditions developed from the Routh criterion, the throttle (i.e., the other dissipative elements in the compression system) dissipates the unsteady energy produced by the compressor over all frequencies, and the compression system is stable.

Consideration of the compression system stability in the limit of large free-rotor inertia, with respect to the critical value illustrates the role of the free-rotor. The second order eigenvalue problem determining system stability is given by:

$$\begin{bmatrix} B\left(\frac{\partial\Psi}{\partial\phi} - 2\phi\tan^2\gamma_f\right) - s & -BM_t \\ \frac{1}{BM_t} & -\frac{1}{BM_t} - s \end{bmatrix} \begin{Bmatrix} \delta\phi_1 \\ \delta\phi_2 \end{Bmatrix} = 0. \tag{26}$$

The eigenvalue problem for the basic compression system without the free-rotor is shown below.

$$\begin{bmatrix} B\left(\frac{\partial\Psi}{\partial\phi}\right) - s & -BM_t \\ \frac{1}{BM_t} & -\frac{1}{BM_t} - s \end{bmatrix} \begin{Bmatrix} \delta\phi_1 \\ \delta\phi_2 \end{Bmatrix} = 0. \tag{27}$$

From this comparison, it is evident that the role of the slope of the quasi-steady compressor characteristic in the conventional compression system is assumed by the real part of the compressor transfer function in the compression system modified with the free-rotor.

Rotating Stall Analysis

The stability of the compression system to axially asymmetric disturbances is shown through an idealized compression system of a two dimensional, quasi-steady, incompressible, linearized actuator disk model. If the free rotor and the compressor are in close aerodynamic communication, it is appropriate to model them together as a single actuator disk because the axial distance between the two is small relative to the length scale of the disturbance. It is believed that the invention is most effective in connection with stabilizing rotating stall if the spacing between the facing edges of the compressor and the free rotor is less than two times the radius of the larger of the two and more preferably, within a single radius.

Figure 7:
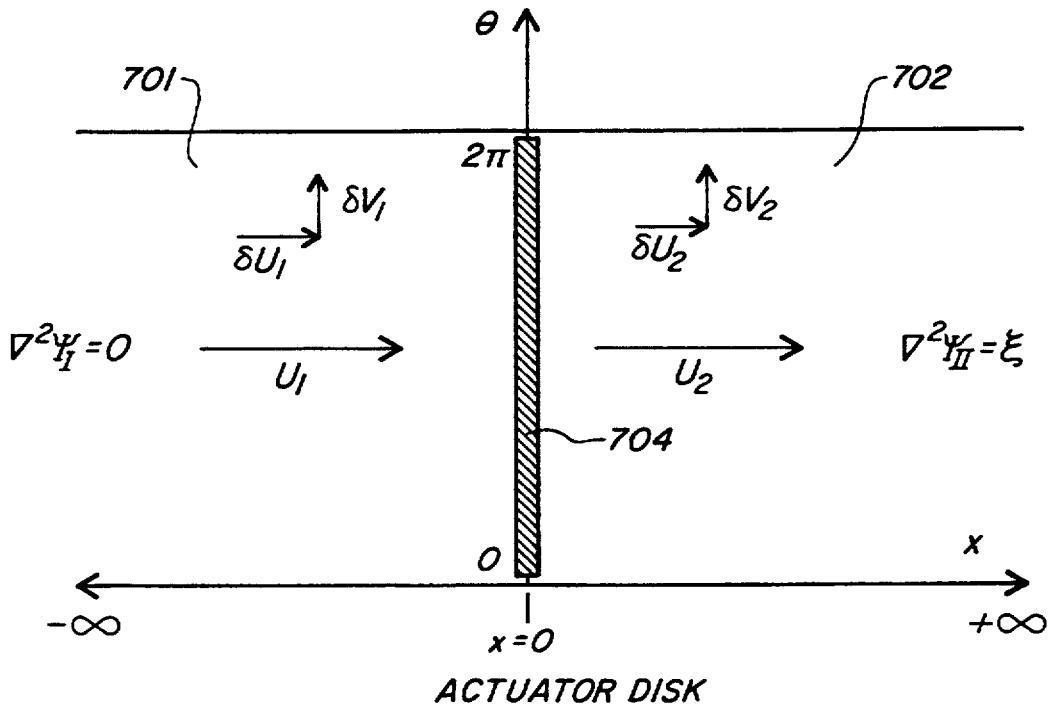
FIG. 7 shows schematically a two dimensional, quasi-steady, incompressible linearized actuator disk model used to analyze the stability of the compression system of the invention to axially asymmetric disturbances.

The geometry used in this analysis is shown schematically in FIG. 7. The basic form of this model has been developed and used by others. See, Moore, F. K., Greitzer, E. M., "A Theory of Post-Stall Transients in Axial Compressors: Part I—Development of the Equations," *ASME Journal of Engineering for Gas Turbines and Power*, Vol. 108, pp. 68–76, (1986), and Longely, J. P., "Inlet Distortion and Compressor Stability", Ph.D. Thesis, Cambridge University (1988). This model has been shown to adequately describe the overall features of rotating stall inception for low speed, high hub-to-tip radius ratio axial flow compressors. Only the major features of the model are outlined herein. For more detailed model development, the following works are instructive. See Moore and Greitzer, Longely cited above.

In this analysis, the rotational speeds of both the compressor and the free-rotor are taken as constant. This is appropriate since, in the linearized model with constant annulus averaged mass flow, no annulus averaged torque is applied to the free-rotor. Thus, the slope of the compressor characteristic for zero-mean, axially asymmetric mass flow oscillations can be assumed to be independent of frequency (i.e. the compressor and the free-rotor operate quasi-steadily for axially asymmetric disturbances).

The fluid dynamic system consists of a flow field 701 upstream of the compressor, the compressor 704, and a downstream flow field 702. The upstream flow field 701 is assumed to be a potential flow field with uniform conditions far upstream of the compressor 704. Downstream of the compressor, the flow field 702 is allowed to be rotational with the amplitude of the disturbances bounded far downstream of the compressor. The effect of the compressor on the two flow fields is incorporated by matching boundary conditions across the actuator disk.

The upstream and downstream streamfunctions are developed as follows. The upstream flow field is not rotational and thus, the stream function for this flow field must satisfy the two dimensional Laplace equation.

$$\nabla^2\Psi_1 = 0, \tag{28}$$

where the subscript "I" refers to the upstream region, generally designated 701. The disturbances are spatially periodic around the annulus of the compressor. Therefore, the tangential dependence of the disturbance can be expressed in terms of its Fourier components.

$$\Psi_I \approx \sum_{-\infty}^{+\infty} A_n e^{in\theta}, \tag{29}$$

where $\theta$ is the angular location around the annulus.

Since the system can be modeled by a linear model, and the harmonics are natural modes of the system, the harmonics can be considered individually. Allowing for these disturbances to rotate or travel around the annulus with an amplitude that is time varying, i.e. growing or decaying, leads to the following form for the tangential (spatial) and time dependencies of the disturbances:

$$\Psi_1 \approx e^{in(\Theta - \sigma t)} g(x), \tag{30}$$

where $\approx$ is an eigenvalue in the time domain and g(x) expresses the axial dependence of the disturbance.

The axial dependence of the disturbance is then determined by the condition of irrotationality and the condition that the disturbance is bounded far upstream:

$$g(x) = e^{n\frac{x}{R}}. \tag{31}$$

Thus, the general form for the disturbance streamfunction for the upstream flow field is given by:

$$\Psi_I = Ae^{in(\theta-\sigma t)+n\frac{x}{R}}. \tag{31a}$$

The downstream flow field may be rotational due to vorticity shed into the flow from the compressor. However, to match the boundary conditions across the compressor, the tangential and time dependence of the downstream flow field must have the same form as the upstream flow field at the actuator disk. Therefore, the downstream flow field must have the form:

$$\Psi_{II} \approx e^{in(\Theta-\sigma t)}h(x) \tag{32}$$

Since the flow is rotational, the stream function is governed by the Poisson equation:

$$\nabla^2\Psi = -\xi \tag{33}$$

$$\xi = \frac{\partial C_\theta}{\partial x} - \frac{1}{R}\frac{\partial C_x}{\partial \theta}$$

Since the flow field is assumed to be inviscid and two dimensional, the vorticity convects with the flow.

$$\frac{D\xi}{Dt} = \frac{\partial \xi}{\partial t} + C_x\frac{\partial \xi}{\partial x} + \frac{C_\theta}{R}\frac{\partial \xi}{\partial \theta} = 0. \tag{34}$$

Substituting the form of the tangential and time dependence of the disturbances from equation 32 into the vorticity equation 34, yields the axial dependence of the vorticity:

$$\xi = e^{in(\theta-\sigma t)-in\frac{x}{R}\left(\frac{C\theta 2}{Cx2}-\frac{R\sigma}{Cx2}\right)}. \tag{35}$$

The homogeneous solution to the Poisson equation 33 governing the downstream flow field is of the same form as the solution for the upstream flow field. Combining the homogeneous and particular solutions yields the following general form of the downstream flow field.

$$\Psi_{II} = Be^{in(\theta-\sigma t)-n\frac{x}{R}} + Ce^{in(\theta-\sigma t)-in\frac{x}{R}\left(\frac{C\theta 2}{Cx2}-\frac{R\sigma}{Cx2}\right)}. \tag{35a}$$

Thus the forms of the upstream and downstream stream functions are given respectively by:

$$\Psi_I = Ae^{in(\theta-\sigma t)+n\frac{x}{R}} \tag{31a}$$

and $$\Psi_{II} = Be^{in(\theta-\sigma t)+n\frac{x}{R}}\,Ce^{in(\theta-\sigma t)-in\frac{x}{R}\left(\frac{C\theta 2}{Cx2}-\frac{R\sigma}{Cx2}\right)}. \tag{35a}$$

The boundary conditions which link the two flow fields are governed by the properties of the compressor and the free rotor, modelled together as one actuator disk in FIG. 7. Because the compressor is short in axial length, mass continuity dictates:

$$\delta C_{\Theta 1} = \delta C_{x2}. \tag{36}$$

The free-rotor has sufficient solidity to fix the relative exit flow angle. Therefore the tangential velocity perturbation at the exit of the actuator disk is linked to axial velocity perturbation through the following relation:

$$\delta C_{\Theta 2} = -\tan\gamma_f\,\delta C_{x2}. \tag{37}$$

The perturbation in the total to static pressure rise across the actuator disk 704 is determined by the combined pressure rise of: 1) the conventional compressor, following its steady state characteristic, 2) the free-rotor, following its steady state characteristic, and 3) the time rate of change of the flow through the compressor (inertia of the fluid within the compressor).

$$\delta P_{S2} - \delta P_{T1} = \left(\frac{\partial \Psi_S}{\partial \phi} - 2\phi\tan^2\gamma_f\right)\delta\phi - \mu\frac{\partial \phi}{\partial \tilde{t}} - \lambda\frac{\partial \phi}{\partial \theta}. \tag{38}$$

In the above expression, $\mu$ represents the inertia of the fluid within both the stationary and rotating blade rows of the compressor (See Longely, cited above) 704 and $\gamma$, represents the inertia of the fluid within the rotating blade rows only.

Substituting the assumed forms for the upstream and downstream flow fields from equations nos. 31a and 35a into equations 36, 37 and 38 yields the following expression for the eigenvalue determining the time dependence of the disturbance in a compression system with no mean inlet or exit swirl:

$$\tilde{\sigma} = \frac{U_T\sigma}{R} = \frac{\left(\frac{\partial \Psi}{\partial \phi} - 2\phi\tan^2\gamma_f\right)i + (n\lambda - 2\tan\gamma_f)}{4 + |n|\mu}. \tag{39}$$

Because the time dependence of the system is given by $e^{-in\tilde{\sigma}\tilde{t}}$, the imaginary part of the eigenvalue determines the stability of the system and the real part determines the rotation rate of the disturbances. The inertial parameters affect the growth rate and the rotation rate of the disturbances, yet have no effect on the stability boundary. The system is neutrally stable for all harmonics when:

$$\frac{\partial \Psi}{\partial \phi} = 2\phi\tan^2\gamma_f. \tag{40}$$

In the limit of zero stagger angle, the stability boundary is given by the well known result (See Longely, cited above) for conventional compressors $$\frac{\partial \Psi}{\partial \phi} = 0. \tag{41}$$

The stability criterion for the compressor with the flee-rotor is the same criterion as for surge in compression systems (assuming the requirements on the slope of the throttle (equation 23a) and free-rotor inertia (equation 24) are met). This criterion also corresponds to the condition where the real part of the compressor transfer function is zero for zero mean, axially asymmetric disturbances.

Maximum Free Rotor Stagger Angle

In the above stability discussion, the effectiveness of the free-rotor in suppressing instabilities was given in terms of the maximum tolerable steady state slope of the compressor characteristic. Theoretically any compressor could be stabilized with a single free-rotor to any positive steady state compressor slope less than the throttle slope by arbitrarily increasing the stagger angle and the inertia of the free-rotor. However, this is not believed to be a realistic situation (although it has not yet been demonstrated to be unrealistic) since other constraints will limit the realizable effectiveness of the device. One of these issues is maximum free-rotor speed. Another may include the need to incorporate free-rotors spaced axially in compressors of significant axial length.

The equilibrium tip speed of the free-rotor is determined by the stagger angle and the axial through flow velocity. Any limit placed on the rotational speed of the free-rotor will limit the maximum allowable free-rotor stagger angle. The maximum tip speed of rotors in modern compression systems is limited by many factors which include: losses as the relative inlet Mach number increases; aeroelastic instability, and aeroelastic and mechanical loading. It is believed that the same constraints will apply to a free-rotor. Therefore, the maximum tip speed of the free-rotor is believed to be on the order of compressor tip speed.

For fixed stagger angle, the maximum free-rotor speed will occur at maximum flow conditions. The relation for the maximum stagger angle in terms of the maximum flow coefficient and maximum free-rotor tip speed is given by.

$$\tan\gamma_{fmax} = \frac{\tilde{U}_{fmax}}{\phi_{max}}. \tag{42}$$

Incorporating this relation into the simplified stability criterion set forth in equation 8 yields the following expression for the maximum controllable steady state slope in terms of the maximum free-rotor tip speed:

$$\frac{\partial\Psi}{\partial\phi} = 2\phi\frac{\tilde{U}^2_{fmax}}{\phi^2_{max}}. \tag{43}$$

In this approach, the maximum free-rotor speed is reached at maximum flow conditions, where the compressor is operating well away from stall. If a mechanism, such as an anti reversing dutch or ratchet or some other governing means is incorporated to prevent free-rotor overspeed at high flow conditions, the effectiveness of a single free-rotor in suppressing instabilities is increased.

Stable Flow Range Extension

Figure 8:
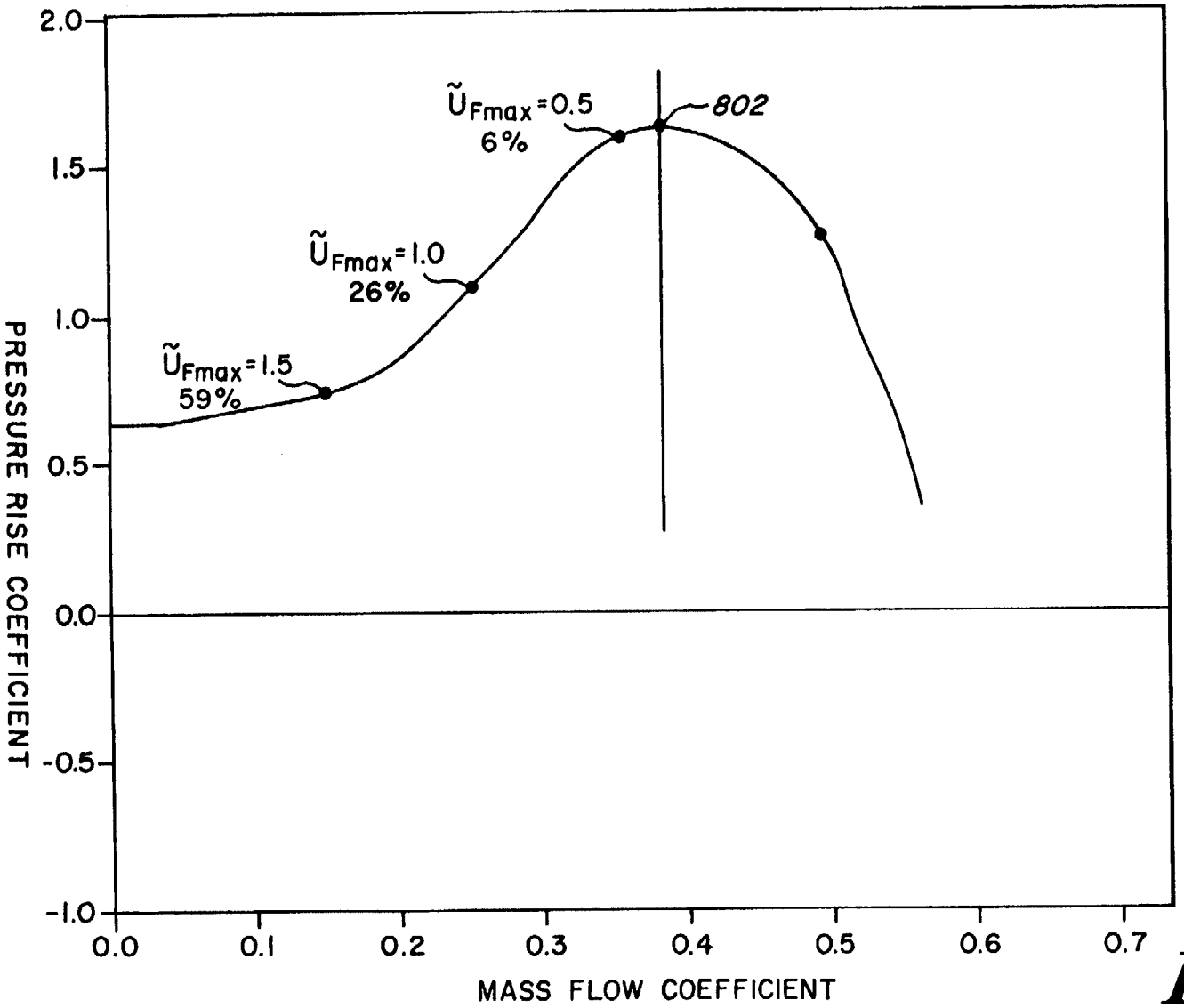
FIG. 8 shows schematically an axially symmetric compression system characteristic representative of a three stage, low speed research compressor, showing the effect of incorporating the apparatus of the invention for various values of free-rotor rotation rates.

The extension of the stable flow range of a compression system modified with a free-rotor will be dependent on the specific compressor's steady state characteristic and the maximum tolerable slope of the steady state compressor characteristic. To demonstrate the potential range extension due to a single free-rotor, an axially symmetric characteristic representative of a three stage low speed research compressor is shown in FIG. 8. (Additional free-rotors would be proportionally more effective.) The stability boundary is indicated for various values of free-rotor wheel speed. For this stability calculation, the maximum flow coefficient was assumed to be $\phi_{max}=0.5$, corresponding to the operating point with the maximum free-rotor rotation rate. The stability boundary 802 shown denotes both the rotating stall and surge boundaries for compression systems meeting the constraints on throttle slope and free-rotor inertia.

As shown, the range extension is strongly dependent on the maximum allowable free-rotor rotation rate. For a baseline case with the maximum free-rotor speed equal to the compressor speed, ($\tilde{U}_f=1.0$ at $\phi=0.5$), a 26% increase in the stable flow range is predicted.

The invention provides a method to stabilize compression systems by modifying the unsteady system dynamics. The real part of the compressor transfer function determines the unsteady energy production, or dissipation, of the compressor and thus plays a dominant role in the stability of the compression system. Focusing on this simplified stability criterion allows for a physical interpretation of the cause of compression system instabilities (both rotating stall and surge) and outlines a criterion that is generally applicable to methods for stabilizing compression systems using close coupled flow devices.

Increasing the stable operating range using active control techniques has been shown to be effective by others. See Paduano, J., Epstein, A. H., Longley, J. P., Valavani, L., Greitzer, E. M., Guenette, G. R., 1991, "Active Control Of Rotating Stall in a Low Speed Axial Compressor," *ASME Paper* 91-GT-88; and Pinsley, J. E., Guenette, G. R., Epstein, A. H. and Greitzer, E. M., "Active Stabilization of Centrifugal Compressor Surge," *Journal of Turbomachinery,* Vol. 113, pp. 723–732. The invention provides a new approach to achieve this stabilization without actuators, sensors or computational devices.

The method of the invention exploits this new approach to increase the stable flow range of compression systems. Close-coupling a rotor that is free to windmill in the flow to a conventional compressor significantly extends the stable flow range with minimal if any steady state performance penalties (ideally).

It is believed that the amount of range extension for a single free-rotor is limited only by the maximum tip speed of the free wheeling rotor.

TABLE I

| | Nomenclature |
|---|---|
| A | Area |
| A | Routh Coefficient |
| A,B,C | Complex Amplitudes of Perturbation Stream functions |
| B | Compression System Stability Parameter |
| C | Flow Velocity |
| D | Diffusion Factor |
| E | Perturbation Energy |
| J | Free Rotor Inertia |
| L | Length |
| M | Real Part of Pressure Rise Versus Mass Flow Transfer Function |
| $\dot{m}$ | Mass Flow Rate |
| P | Pressure |
| R | Radius |
| s | Eigenvalue in Surge Analysis |
| t | time |
| U | Wheel Speed |
| V | Volume |
| W | Relative Flow Velocity |
| x | Axial Coordinate |
| | Greek Symbols |
| $\delta$ | Perturbation Quantity |
| $\phi$ | Mass Flow Coefficient |
| $\gamma$ | Stagger Angle |
| $\Psi$ | Total to Static Pressure Rise Coefficient |
| $\frac{\partial\Psi}{\partial\phi}$ | Slope of Quasi-Steady, Axisymmetric Compressor Characteristic |
| $\tau$ | Torque |
| $\rho$ | Density |
| $\omega$ | Frequency |
| $\xi$ | Vorticity |

TABLE I-continued

| | |
|---|---|
| $\theta$ | Tangential Coordinate |
| $\mu$ | Compressor Inertial Parameter |
| $\lambda$ | Compressor Inertial Parameter |
| $\sigma$ | Eigenvalue for Rotating Stall Analysis |
| $\kappa$ | Solidity |
| | Subscripts |
| c | compressor |
| f | free-rotor |
| h | Helmholtz |
| in | inlet duct |
| n | harmonic number |
| p | plenum |
| s | Static |
| T | Tip of conventional compressor |
| T | total |
| x | axial |
| $\theta$ | tangential |
| 0,1,2 | axial stations |
| I,II | upstream and downstream flow fields |
| | Superscripts |
| ~ | nondimensional quantity |

The foregoing discussion should be understood as illustrative and should not be considered to be limiting in any sense. While this invention has been particularly shown and described with references to preferred embodiments thereof, it will be understood by those skilled in the art that various changes in form and details may be made therein without departing from the spirit and scope of the invention as defined by the claims.

Figure 10:
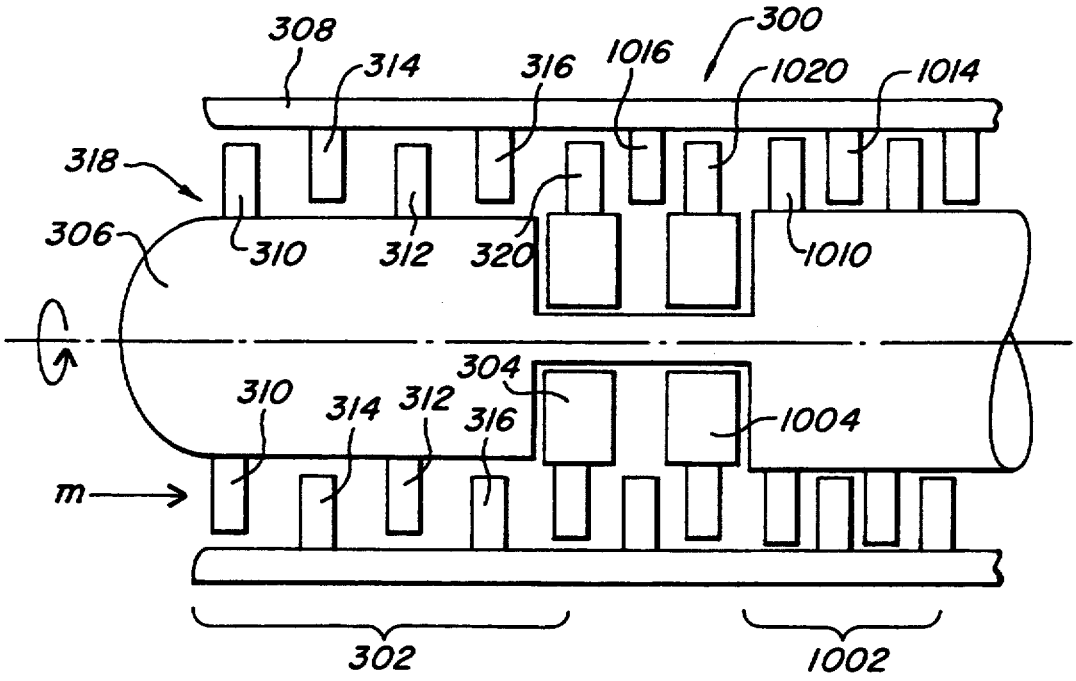
FIG. 10 shows schematically a preferred embodiment of the apparatus of the invention in a longitudinal cross-section, having multiple stages of blade rows, with two free-rotors between two blade row stages, separated by a stationary blade row.

For instance, the invention can be used in connection with any implementation of turbo machine, including but not limited to compressors, pumps or fans, including but not limited to aircraft engines, turbochargers, air conditioners, ventilation systems, stationary gas turbines, pumps, power plant and industrial fans. The system can be axial or centrifugal or a combination of the two. The free-rotor can be placed before or after a standard compression stage, or between pairs of stages. Such an arrangement is shown schematically in FIG. 10, with a second stage having rotating blades 1010. A free rotor 304 is mounted between the first stage 302 and the second stage 1002. In multistage centrifugal machines, free-rotors can be placed in the interstage connecting ductwork. Thus, they need not be mounted concentric with a compressor stage of the apparatus. More than one free-rotor can be used in a system either adjacent (if counter rotating) or separated from each other by a stationary blade row, 1016 such as is shown in FIG. 10 with the two free rotors 304 and 1004.

Figure 9:
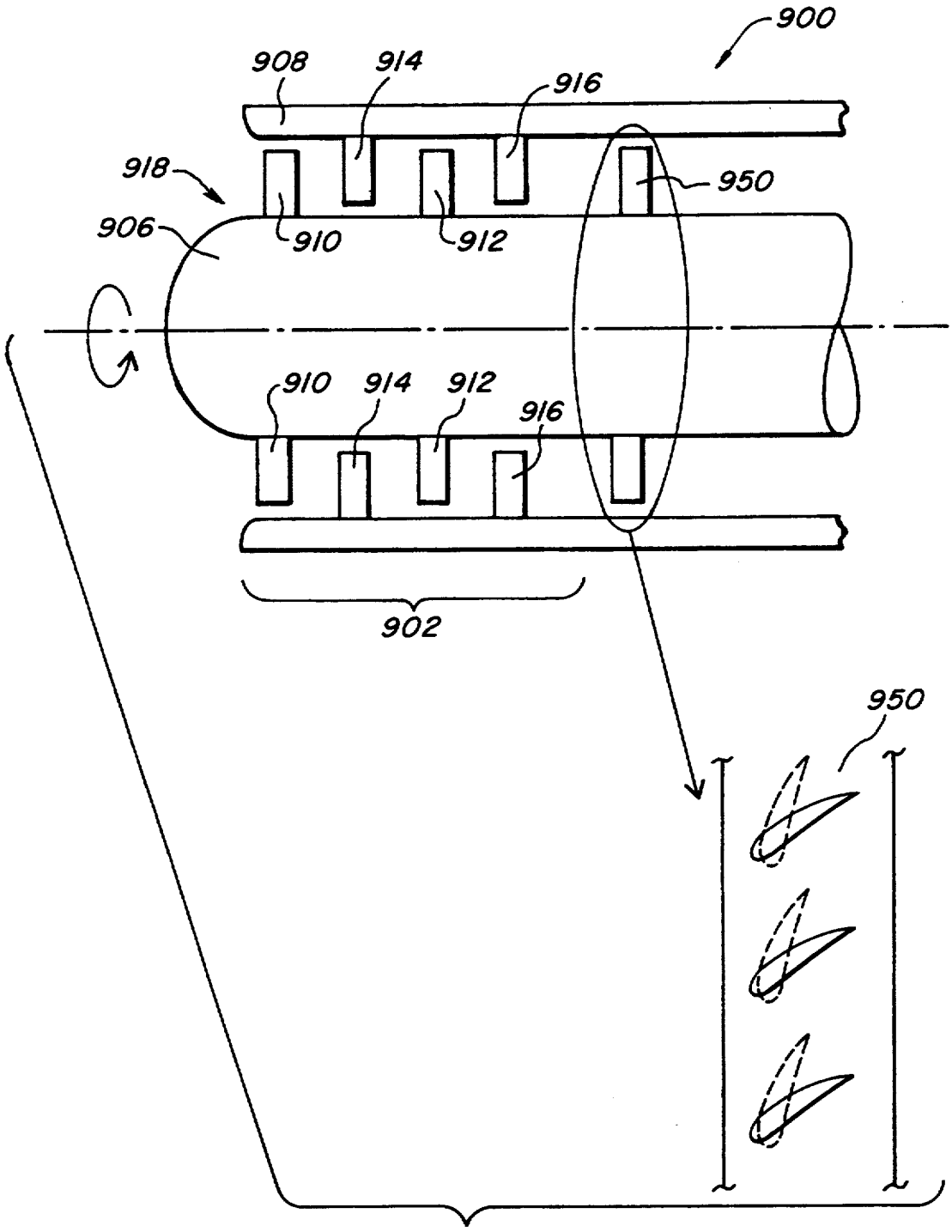
FIG. 9 shows schematically a second preferred embodiment of the claimed apparatus of the invention having a blade row with pivoting blades, in a longitudinal cross-section.

Rather than a free-rotor, other devices that accomplish the same effect can be used as described above. As shown in FIG. 9, a blade row that has a variable stagger angle, fixed to the spool of the rotor is another embodiment of the invention. In this implementation, the stagger angle of the blades in blade row 950 would be self adjusting (through aerodynamic forces) to zero the mean pressure rise (across the row). A possible feedback mechanism is to pivot the rotors upstream of the center of pressure. The angular position (or stagger angle) would then naturally seek a zero incidence angle (and thus zero pressure rise). As shown in FIG. 9, the blade positions shown in solid lines are typical for a high flow coefficient and the blade positions shown in phantom are typical for a low flow coefficient. Inertia would prevent the stagger angle from responding to short time scale disturbances. Such an apparatus would have a similar effect as the free-rotor, that is, stabilizing rotating stall and surge without degrading performance.

Such an apparatus would also constitute a unitary sensor and feedback device, since it is the variable stagger angle blades that both are affected by the perturbation, and that resist the effects of the perturbation due to their inertia.

Having described the invention, what is claimed is:

1. A compressing turbo machine comprising:

a. a rotatably mounted axial blade row rotor carrying a first compressing blade row; and b. at least one free-rotor, the at least one free-rotor:

i. spaced from the compressing blade row so as to provide aerodynamic feedback to the compressing blade row;

ii. mounted freely rotatably with respect to the compressing blade row; and iii. having a blade row of angled blades, with the stagger angle of the blades such that the magnitude of the rotational speed of the free-rotor at its steady state maximum mass flow operating conditions is at least 0.5 times the magnitude of the rotational speed of the compressing blade row rotor at its steady state maximum mass flow operating conditions.

2. The turbo machine of claim 1, at least one of the free-rotor(s) mounted adjacent the compressing blade row.

3. The turbo machine of claim 2, at least one of the free-rotor(s) mounted coaxially with respect to the axis of rotation of the compressing blade row.

4. The turbo machine of claim 3, at least one of the free-rotor(s) mounted upstream of the compressing blade row.

5. The turbo machine of claim 3, at least one of the free-rotor(s) mounted downstream of the compressing blade row.

6. The turbo machine of claim 1, comprising a second compressing blade row, with at least one of the free-rotor(s) mounted between the first compressing blade row and the second compressing blade row.

7. The turbo machine of claim 2, wherein the free rotor is spaced from the compressing blade row within a distance of twice the larger of the radii of the free rotor and the compressing blade row.

8. The turbo machine of claim 2, wherein the free rotor is spaced from the compressing blade row within a distance of the larger of the radii of the free rotor and the compressing blade row.

9. The turbo machine of claim 1, at least one of the free-rotor(s) arranged to rotate counter the rotation of the compressing blade row.

10. The turbo machine of claim 1, comprising at least two free-rotors.

11. The turbo machine of claim 1, further comprising ductwork that provides a pathway for the aerodynamic communication between the compressing blade row and the free-rotor.

12. The turbo machine of claim 1 wherein the compressing blade row comprises a pumping blade row.

13. The turbo machine of claim 1 wherein the compressing blade row comprises a fan blade row.

14. A compressing turbo machine comprising a rotatably mounted blade row having a variable stagger angle that is automatically changed by fluid flow,.so that the mean pressure difference across the blade row is substantially zero.

15. A turbo machine for use in a compression system, said turbo machine comprising:

a. a rotatably mounted blade row rotor carrying a compressing blade row; and b. at least one free-rotor, the at least one free-rotor:

i. spaced from the compressing blade row so as to provide aerodynamic feedback to the compressing blade row;

ii. mounted freely rotatably with respect to the compressing blade row;

iii. having a blade row of angled blades, with the stagger angle of the blades such that the magnitude of the rotational speed of the free-rotor at its steady state maximum mass flow operating conditions is at least 0.5 times the magnitude of the rotational speed of the compressing blade row rotor at its steady state maximum mass flow operating conditions; and iv. having a nondimensional inertia $\tilde{J}\phi B^2 M_t$, where $\phi$ is the mass flow coefficient for the turbo machine at the peak of its compressor characteristic curve, B is the stability parameter for the compression system in which the turbo machine operates and $M_t$ is the slope of the throttle characteristic of any throttling elements connected to said turbo machine.

16. The turbo machine of claim 15, at least one of the free-rotor(s) mounted downstream of the compressing blade row.

17. The turbo machine of claim 15, at least one of the free-rotor(s) arranged to rotate counter the rotation of the compressing blade row.

18. The turbo machine of claim 15, further comprising at least two free-rotors.

19. The turbo machine of claim 15, further comprising ductwork that provides a pathway for the aerodynamic communication between the compressing blade row and the free-rotor.

20. The turbo machine of claim 15, wherein the compressing blade row is a centrifugal blade row.

* * * * *

UNITED STATES PATENT AND TRADEMARK OFFICE

CERTIFICATE OF CORRECTION

PATENT NO. : 5,437,539

DATED : August 1, 1995

INVENTOR(S) : Daniel L. Gysling and Jonathan S. Simon

It is certified that error appears in the above-indentified patent and that said Letters Patent is hereby corrected as shown below:

Column 22, Line 64 replace "flow,.so" with --flow so-- to read: "that is automatically changed by fluid flow so that the . . .".

Column 23, Line 17 replace "$\tilde{J}\phi B^2 M_t$" with --$\tilde{J} \geq \phi B^2 M_t$-- to read: "iv. having a nondimensional inertia $\tilde{J} \geq \phi B^2 M_t$, where..."

Signed and Sealed this

Thirty-first Day of October 1995

*Attest:*

*Attesting Officer*

BRUCE LEHMAN

*Commissioner of Patents and Trademarks*